US005249989A

United States Patent [19]

Alsch

[11] Patent Number: 5,249,989

[45] Date of Patent: Oct. 5, 1993

[54] TERMINAL SCREW ASSEMBLY

[75] Inventor: Gottfried Alsch, Vienna, Austria

[73] Assignee: Hubert L. Naimer, Ascona, Switzerland

[21] Appl. No.: 778,943

[22] PCT Filed: May 2, 1991

[86] PCT No.: PCT/AT91/00062

§ 371 Date: Dec. 16, 1991

§ 102(e) Date: Dec. 16, 1991

[87] PCT Pub. No.: WO91/17588

PCT Pub. Date: Nov. 14, 1991

[30] Foreign Application Priority Data

May 2, 1990 [AT] Austria ..... 996/90

[51] Int. Cl.[5] ..... H01R 4/34; H01R 4/38

[52] U.S. Cl. ..... 439/812; 439/813

[58] Field of Search ..... 439/810, 812, 813, 811, 439/709, 814, 801, 793

[56] References Cited

U.S. PATENT DOCUMENTS

| | | | |
|---|---|---|---|
| 3,994,556 | 11/1976 | Jensen et al. | 439/801 |
| 4,478,478 | 10/1984 | Durand et al. | 439/625 |
| 4,611,876 | 9/1986 | Barrabes | 439/810 |
| 4,830,627 | 5/1989 | Heng et al. | 439/586 |

FOREIGN PATENT DOCUMENTS

| | | | |
|---|---|---|---|
| 280672 | 8/1988 | European Pat. Off. | 439/814 |
| 3028958 | 2/1981 | Fed. Rep. of Germany . | |
| 8702835.2 | 2/1987 | Fed. Rep. of Germany . | |
| 2538174 | 6/1984 | France . | |
| 148056 | 7/1985 | France . | |
| 2611992 | 9/1988 | France . | |

*Primary Examiner*—Gary F. Paumen

*Attorney, Agent, or Firm*—Nixon & Vanderhye

[57] ABSTRACT

An electrical screw-on terminal assembly is provided for a connection to wires or cables, particularly those with eye connectors. The terminal assembly has a housing and a screw which, as it is screwed in, passes through a first plate, and when fully screwed in, a second plate. The first plate is mounted so that it cannot rotate or be moved longitudinally, while the second plate is mounted so that it can be moved longitudinally but not rotated. When the terminal is completely open, the second plate abuts a stop on the housing and is held in this position by a resistive force, which can be overcome by the screw, so that the aperture onto which the cable or cable eye is inserted remains unobstructed. The screw can be screwed into a bore in the first plate until it engages the second plate. The bore in the first plate has no internal thread, but has projections which engage the screw threads.

20 Claims, 5 Drawing Sheets

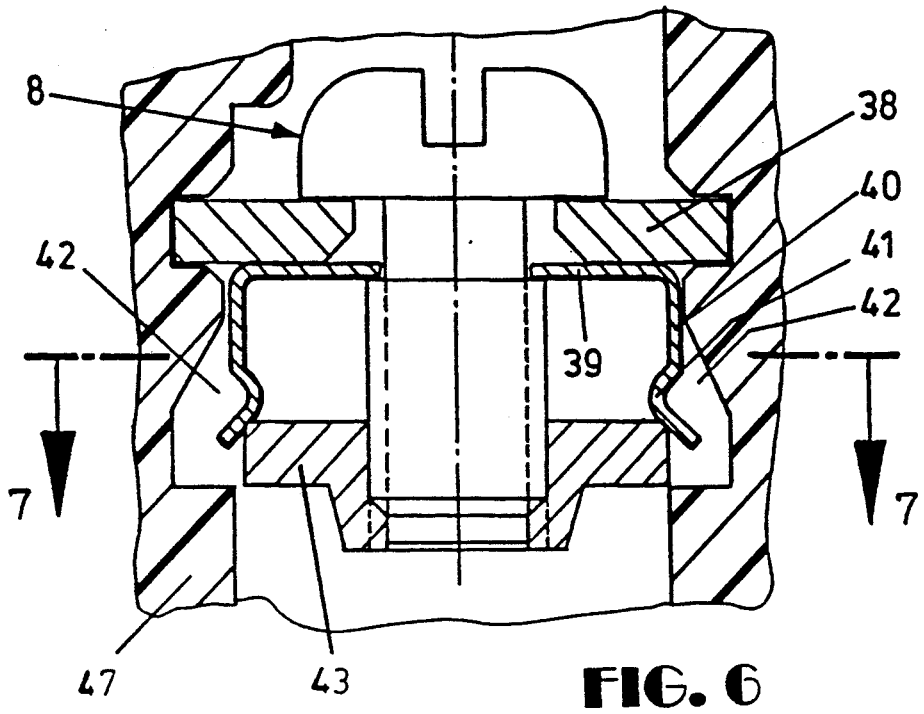
FIG. 6
FIG. 7
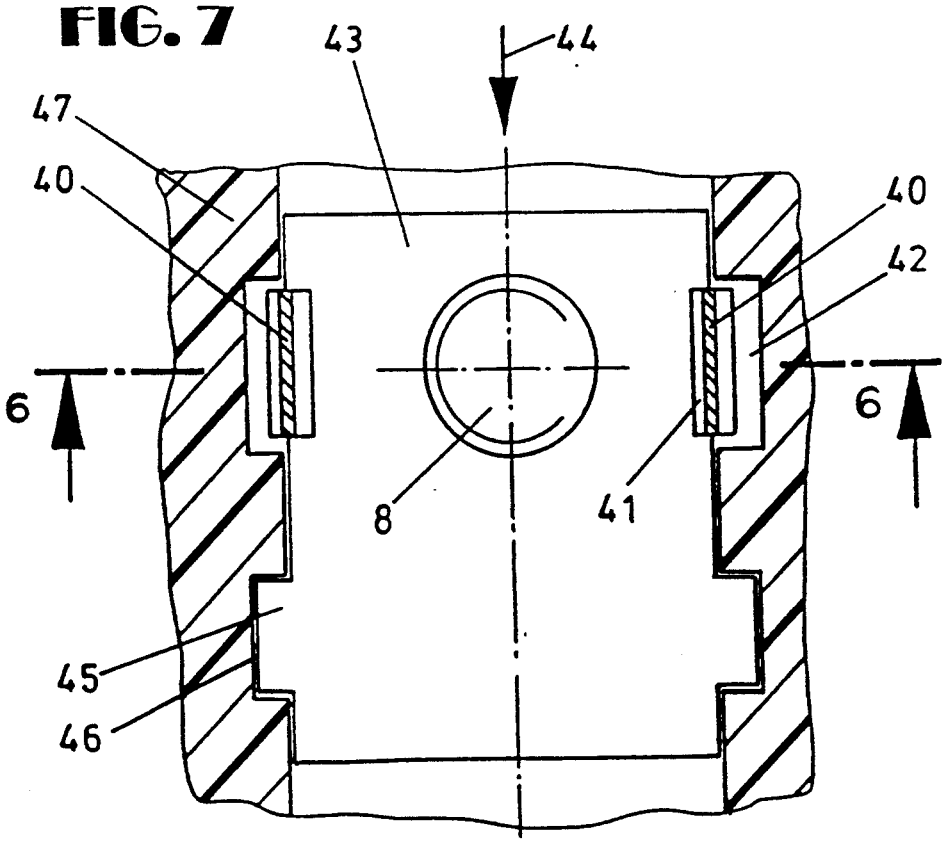

TERMINAL SCREW ASSEMBLY

BACKGROUND AND SUMMARY OF THE INVENTION

The invention relates to a terminal screw assembly for the electrical connection of cables or wires, in particular cables and wires provided with ear-shaped cable terminals. In one exemplary embodiment, the terminal screw assembly comprises a housing and a clamping screw which, in the screw in direction, penetrates through a first clamping plate and, when the terminal is closed, through a second clamping plate and, when the terminal is open, remains sunk in a bore of the first clamping plate and opens up the interspace between the first and the second clamping plate, the clamping screw being screwconnectable in the bore of the first clamping plate, and the second clamping plate comprising a bore having a screw thread, and wherein the shank of the clamping screw is reduced to a small diameter in a region which is adjacent to the screw head and the axial length of which at least corresponds to the axial length of the engagement of the first clamping plate in threads of the clamping screw.

Terminal screw assemblies of this kind are, for example, used as connecting terminals for switches, electrical apparatus, such as motors, or also for sockets. Such a terminal assembly has been disclosed in U.S. Pat. No. 4,611,876. According to that U.S. patent, the second clamping plate is arranged in the housing in a fixed manner, whereas the first clamping plate is displaceable in the axial direction. In order, in this case, to limit the screw-out movement of the clamping screw and to retain the clamping screw in the bore of the first clamping plate, in the open position of the terminal, the clamping screw is guided in a cage which is connected to the first clamping plate. This cage is guided to be non-rotatable and to be axially displaceable in the housing, with clearance. Depending on the position of the terminal, said cage, therefore, either falls with the first clamping plate on to the second clamping plate, or it moves away therefrom. Thus, when the terminal is open, the free spacing between the first and the second clamping plate is not ensured, with the result that, when the terminal is open, the insertion of the cable or the cable terminal between the first and the second clamping plate is rendered more difficult. This is the case, in particular, when the terminal screw is not readily accessible or during overhead installation. In addition, the design of the first clamping plate comprising a cage retaining the clamping screw is complex.

The object of the invention is, therefore, to develop a terminal screw of the kind mentioned at the outset in such a way that the insertion of cables, in particular cables having ear-shaped cable terminals, is substantially simplified. In order to meet this object, the design according to the invention essentially comprises that the first clamping plate is non-displaceable and non-rotatable in the axial direction of the clamping screw, and the second clamping plate is guided to be non-rotatable and, when the terminal is open to the maximum, to be displaceable, in the axial direction of the clamping screw, out of its position, and that the second clamping plate is held by a slight resistance (for example, by friction) in the maximum open terminal position, in which position the clamping screw, when completely screwed through the first clamping plate, engages the internal screw thread of the second clamping plate, the opening path of the clamping screw being defined by its stopping against a part of the wall of the housing.

As a result of the fact that the first clamping plate is designed to be axially non-displaceable and non-rotatable, the limit stop for the opening path of the clamping screw can, in a simple manner, be formed by a part of the wall of the housing, without requiring additional components. The opening path of the clamping screw is, in this regard, dimensioned such that the clamping screw, in the open position, remains in the bore of the first clamping plate and does not project beyond the clamping face of the first clamping plate. As a result of the fact that the second clamping plate, which is non-rotatable and displaceable in the axial direction of the clamping screw, is held in the maximum open position of the terminal by a resistance, this maximum open position is ensured and the insertion of the cable or cable terminal is simplified in this position of the terminal screw. It is now no longer possible for the second clamping plate to drop towards the first clamping plate, as a result of the force of gravity, thereby obstructing the insertion of the cable or the cable terminal. As a result of the selection of the dimensions such that the clamping screw, when completely screwed through the first clamping plate, engages the thread of the second clamping plate, it is possible to close the terminal while overcoming the resistance which holds the second clamping plate in the maximum open position of the terminal.

This resistance can, in a simple manner, be a friction resistance which is adequate to hold the second clamping plate in its maximum open position, which is defined by a limit stop on the housing, but which can be overcome without difficulty during displacement of the clamping plate.

According to a preferred embodiment of the invention, the bore in the first clamping plate is designed without an internal screw thread, and the first clamping plate is provided with projections which project inwards and form parts of threads and engage in a thread of the clamping screw, with a clearance in parts. This provides the advantage that, although the projections permit a screwing insertion of the clamping screw until the second clamping plate is reached, they do provide a clearance such that the clamping screw can readily engage the first thread of the internal screw thread of the second clamping plate. During continued screwing into the first clamping plate, said projections are completely released, as a result of the fact that the shank of the clamping screw is designed to be reduced to a smaller diameter in the region of the screw head, such that the complete screw-fastening of the second clamping plate is not obstructed. According to the invention, the second clamping plate may, for example, have at least one tongue which is angled off in the axial direction of the clamping screw, perpendicular relative to the clamping face, which tongue is guided between guiding faces of the housing, said guiding faces being disposed in the axial direction of the clamping screw, and the tongue is clamped with friction contact between these guiding faces, and these guiding faces may have projections which clamp the tongues in a friction-tight manner, in order to reduce the friction to a minimum. According to a preferred embodiment, it is, however, also possible to provide the first clamping plate with resilient claws, the ends of which are curved in the direction of the axis of the clamping screw and lap over the second clamping plate and hold it back resiliently, in the maximum open position of the terminal. As a result hereof, the second clamping plate would be held more reliably in its stopping position on the housing and the resistance during the displacement of said clamping plate is more readily adjusted.

Said projections may be formed, for example, on projections along the thread-less bore wall of the first clamping plate or by a ridge which is cut by the clamping screw. According to a preferred embodiment of the invention, the arrangement is, however, such that the projections which engage in a thread of the clamping screw are provided on a resilient disc, preferably of spring steel sheet, which is connected to the first clamping plate and is provided with a bore, the diameter of which is smaller than the outside diameter and larger than the core diameter of the screw thread of the clamping screw, from which radiate a number of radial slits which divide the inner region of the disc into tongues which engage in at least one thread of the clamping screw. Preferably, this resilient disc is attached to a surface or the first clamping plate, for example by spot welding. According to the invention, the resilient disc may, in this regard, be secured to the clamping face of the first clamping plate, and the resilient claws which, in the complete open position, lap over the second clamping plate, may be integral with the resilient disc. This resilient disc can, preferably, be composed of beryllium bronze which has a good electric conductivity and a high elasticity. It is, in this regard, appropriate that the edge of the bore in the first clamping plate is rounded off or provided with a conical depression on that side which faces the elastic disc, in order to permit the tongues formed on the disc to deflect into the thread of the clamping screw.

According to the invention, it is expedient that the spacing between the first clamping plate and the limit stop, which defines the opening movement of the clamping screw and is formed by a part of the wall of the housing, is dimensioned such that, in the stopping position, the clamping screw sinks into the bore of the first clamping plate but does not project, at least not substantially, beyond the clamping face of the first clamping plate. In this manner, the clamping screw can be screwed into the projections of the bore of the first clamping plate until the clamping screw engages the second clamping plate. According to the invention, the housing in the axis of the clamping screw may have an opening for penetration by a screwdriver, the smallest dimension of which opening is smaller than the diameter of the head of the clamping screw, such that the edge of said opening itself forms the limit stop for the opening path of the clamping screw. In addition, the advantage is provided that the clamping screw cannot be lost and is protected by this counterbore.

According to the invention, the axial length of that part of the clamping screw which is provided with a thread is greater than the axial spacing between the clamping face of the second clamping plate and the ridge or inwardly projecting projections or the resilient disc of the first clamping plate, when the terminal is open to a maximum, such that the clamping screw can reliably be screwed through the opening in the first clamping plate until it engages the second clamping plate, in the maximum open position of the terminal. It is, in this regard, expedient that the free end of the shank of the screw is designed as a thread-less centering pin, such that it is ensured that the thread of the second clamping plate is engaged. The bore of the second clamping plate is provided with a normal screw thread.

The clearance between the rigid projections or the ridge of the first clamping plate and the thread of the clamping screw is expediently dimensioned such that the projections which engage in a thread of the screw, or the engaging ridge, are disposed on an inside diameter which is greater than the core diameter of the screw by at least 30%, preferably 40 to 70%, of the difference between the core diameter and outside diameter of the screw.

The invention will be described hereinafter in more detail with reference to exemplified embodiments which are diagrammatically illustrated in the drawings.

BRIEF DESCRIPTION OF THE DRAWINGS

FIGS. 3, 4 and 5 show a modified embodiment of the terminal screw, wherein FIG. 3 shows the terminal screw assembly in the open position, and FIG. 4 shows the terminal screw in closed position, and FIG. 5 shows a view from below of the resilient disc according to FIGS. 3 and 4. FIGS. 6, 7 and 8, again, show a different embodiment of the terminal, wherein FIG. 6 shows a section along line VI—VI of FIG. 7, FIG. 7 shows a section along line VII—VII of FIG. 6, and FIG. 8 shows a perspective view from below of a first clamping plate according to FIG. 6.

DETAILED DESCRIPTION OF THE DRAWINGS

Figure 1:
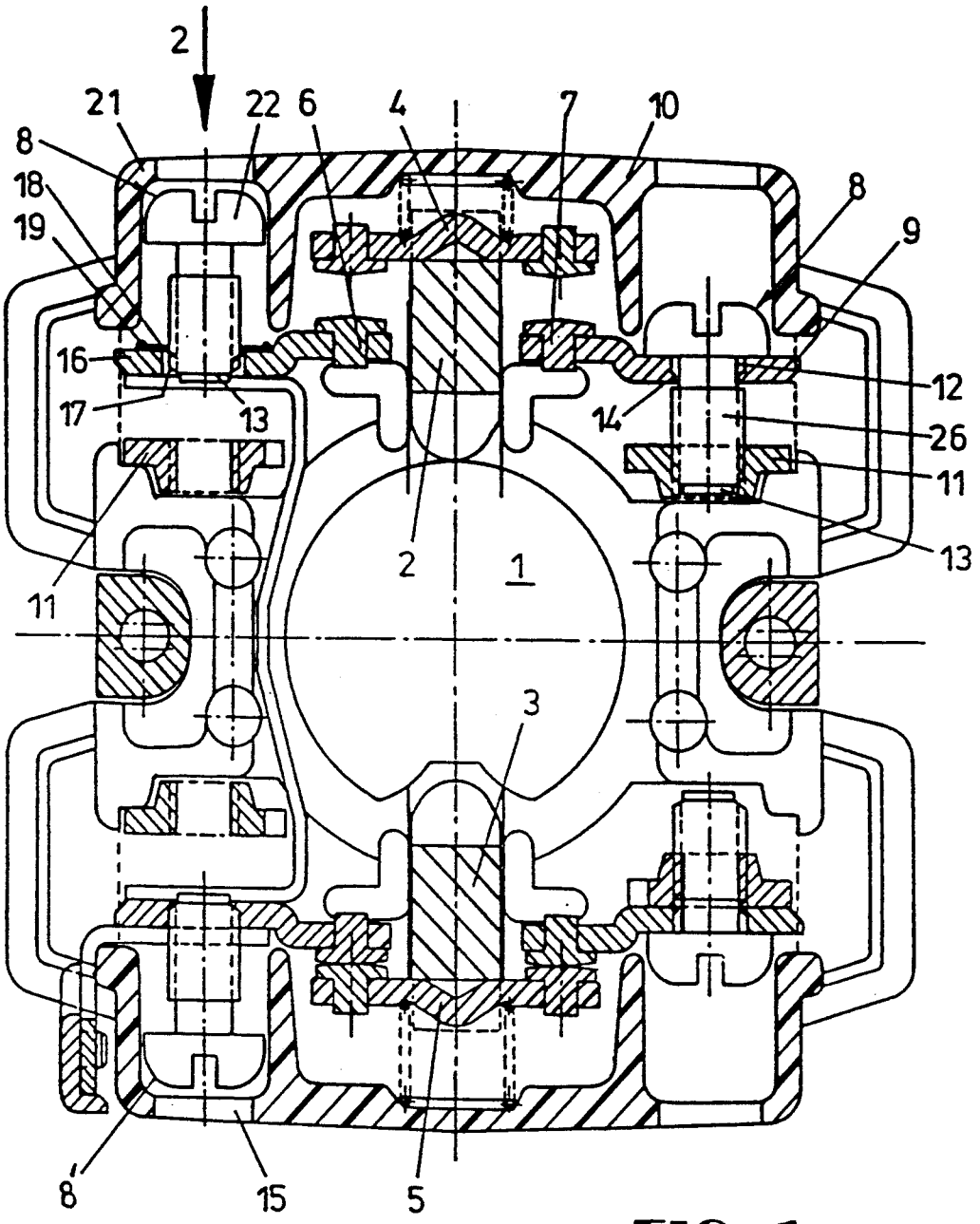
FIG. 1 shows a cross-section of a multiple-deck switch wafer of a gang switch provided with terminal screws according to the invention.

A gang switch, a multiple-deck switch wafer of which is illustrated in cross-section in FIG. 1, comprises a number of cams 1 which are actuated by means of a common shaft and actuate spring-loaded bridging contacts 4, 5 via plungers 2, 3. The stationary contacts 6 and 7, which are associated with the bridging contact 4, are provided with terminal screw assemblies for the connection of cables. Each terminal screw assembly essentially comprises a clamping screw 8, as well as a first clamping plate 9, which is connected to the stationary contact 7, and a second clamping plate 11, which is guided to be non-rotatable and displaceable in the housing 10 of the wafer. The guide means, which are arranged in the housing 10, for the axial, non-rotatable displacement of the second clamping plate 11 are not illustrated. The shank of the screw 8, in a region 12 adjacent to the head, is reduced to a smaller diameter, for example to the core diameter, the axial length of this region of the shank corresponding at least to the thickness of the first clamping plate 9. A thread-less centering pin 13 is formed at the free end of the shank of the screw 8. At that edge of the bore in the first clamping plate 9 which faces the second clamping plate 11, inwardly projecting projections 14 are formed in the bore for the screw 8, which projections engage, with play, in a thread of the threaded portion of the screw 8 and assume the function of an internal screw thread. These projections 14 may also be formed by a ridge which is cut by the clamping screw 8.

When releasing the terminal screw, the threaded portion of the screw 8 withdraws from the second clamping plate 11, while the projections 14 engage in the threaded portion, such that the screw 8, during continued unscrewing, gradually opens up the space between the two clamping plates 9 and 11. With continued unscrewing, the screw 8 ultimately assumes the position 8', as is illustrated in the lower, left-hand quadrant of FIG. 1. In so doing, the opening path of the clamping screw 8 is defined by its stopping against a part of the wall 21 of the housing 10. In this regard, the screw 8 cannot fall out of the housing 10 which is composed of a non-conducting material, e.g. plastics material, since the opening 15 in the housing provided for the application of a screwdriver has a smaller dimension than the screw head 22 of the clamping screw 8. At the same time, the requirements in respect of reliability of contact between live parts of the switch are taken into account by the above arrangement. In this state of the terminal screw, it is possible to insert cable terminals having a ring-shaped closed contour and wire loops between the two clamping plates 9 and 11 without any difficulty. Since, when the terminal is Open, the free end of the shank of the screw 8 remains in the bore of the first clamping plate 9 and, in addition, the centering pin 13 remains between the projections 14, a centered turning down of the screw, in order to tighten the terminal screw, is possible at any time without difficulty. As soon as the screw is screwed sufficiently far through the first clamping plate 9, the centering pin 13 and, subsequently, the threaded portion engage with the internal screw thread of the second clamping plate 11. As a result of continued screwing in of the screw 8, an inserted cable terminal or a wire loop is, ultimately clamped between the two clamping plates 9 and 11. In the left-hand section of FIG. 1, the terminal screw is illustrated in the maximum open state, wherein the second clamping plate abuts against the housing 10. In this position, the second clamping plate is held against the housing by a slight resistance, for example, by friction, with the result that this maximum open position is maintained, whatever the spatial position of the terminal screw, and the insertion of the cable or of the cable terminal is not obstructed. Said resistance is readily overcome by screwing the clamping screw 8 into the second clamping plate.

Figure 2:
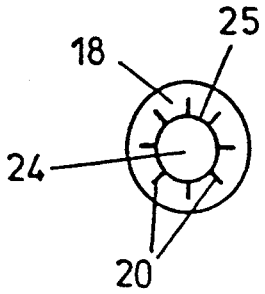
FIG. 2 shows a radially slit disc of spring steel sheet to form projections which engage in a thread of a clamping screw, in a plan view along arrow II of FIG. 1.

A different embodiment of the projections used to hold and guide the screw 8 on the first clamping plate 16 is shown in the upper left-hand quadrant of FIG. 1 and in FIG. 2. The first clamping plate 16 is provided with a thread-less bore 17 for the passage of the screw 8, the diameter of which bore permits the threaded portion of the screw 8 to pass with a clearance.

In this instance, a disc 18 of spring steel sheet is provided for engagement with the threads of the screw 8, which disc rests against that side of the first clamping plate 16 which faces away from the second clamping plate 11 and is secured to the first clamping plate 16 by a number of welding spots. The inner region of the disc 18 is divided into resilient tongues 25 by radial incisions 20, which tongues, during moderate axial inward pressing of the screw and rotation thereof in screw-in direction, resiliently engage in a thread of that region 26 of the clamping screw 8 which is provided with a thread. If required, the clamping screw 8 may also be pressed, ratchet-like, in the radial direction between the elastic projections, without exerting a movement of rotation, until the centering pin 13 enters into the threaded bore of the second clamping plate 11, whereupon the terminal screw is tightened by rotation of the screw 8.

In the upper right-hand quadrant and in the lower right-hand quadrant of FIG. 1, it can be seen that the screw 8, when the head abuts against the first clamping plate, is freely rotatable as desired, without restraint by reason of the screw thread 26 and the projections 14 or 25.

Figure 3:
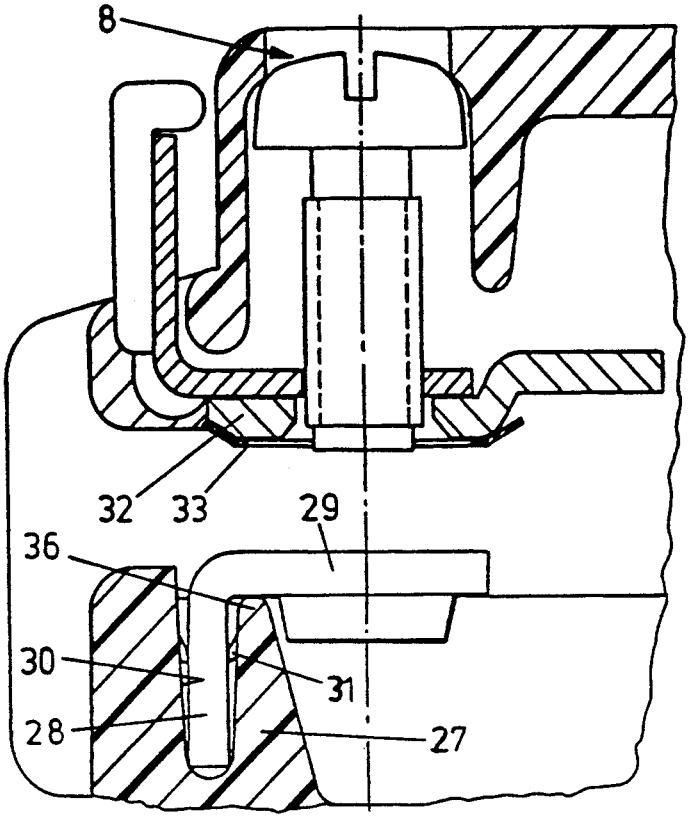
Figure 4:
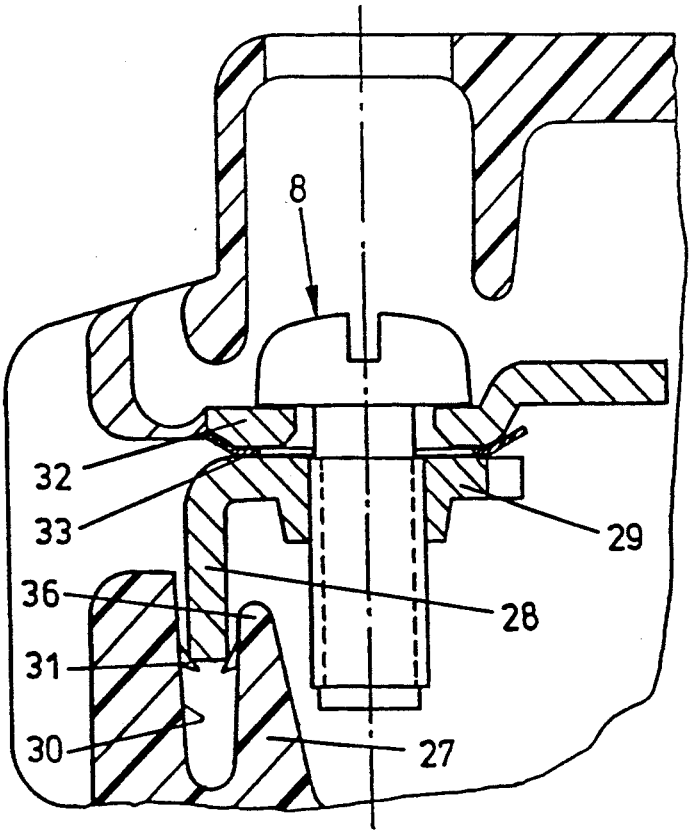
Figure 5:
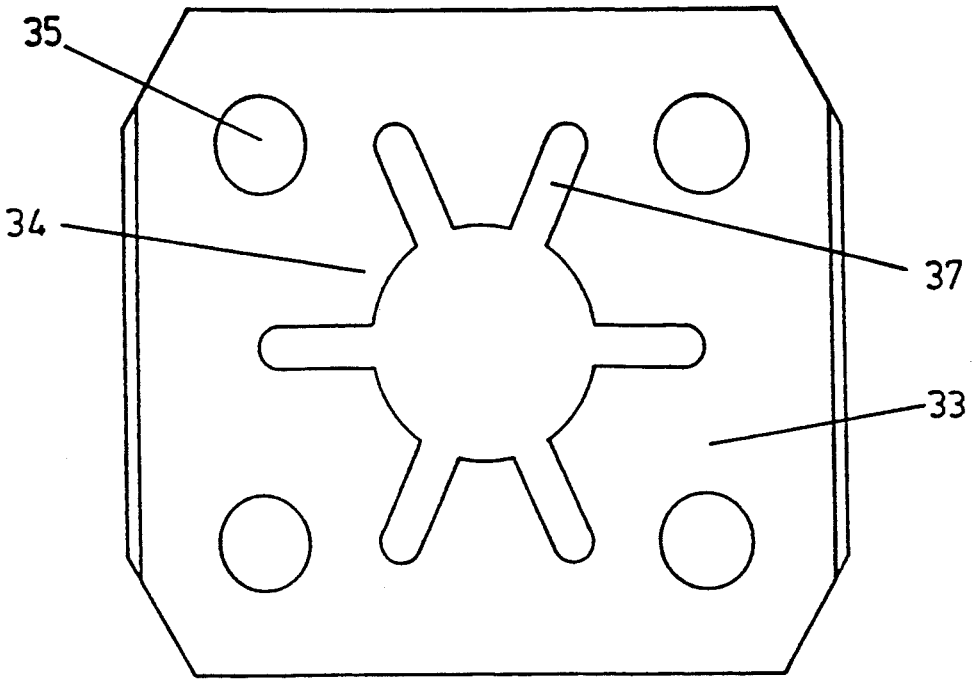

In the embodiment according to FIGS. 3, 4 and 5, the housing 27, which is composed of non-conducting material or plastics material, is provided with a slot 30. The second clamping plate 29 is provided with a tongue 28 which is angled off perpendicularly and extends in the axial direction of the clamping screw 8 and sinks into the slot 30. The tongue 28 is guided with friction in this slot 30. Projections 31 are arranged on the inside of the walls of the slot 30, which projections are integral with the housing and between which the tongue 28 is guided in frictional contact. The degree of friction is more readily adjustable as a result of these projections 31. The fully opened position of the second clamping plate 29 is determined by a limit stop 36 provided in the housing. The first clamping plate 32 is, again, arranged to be non-rotatable and axially non-displaceable, whereas the second clamping plate 29 is axially displaceable and, as result of the tongue 28, non-rotatable.

The resilient disc 33 is now arranged on the clamping face of the first clamping plate 32 and is, as shown in FIG. 5, riveted to the first clamping plate 32 at 35. These rivets 35 can either by formed as piercing rivets, or they can be formed by projections from the first clamping plate 32 which are riveted after mounting of the resilient disc 33. The resilient disc 33, again, comprises a central bore from which radiate slots 37 which divide the edge of the bore into tongues 34. In this instance, six tongues 34 are provided and the slots 37 have a width such that the tongues 34 do not abut against each other. This facilitates the screwing-in of the clamping screw 8, whereby the tongues 34 are bent down.

Figure 8:
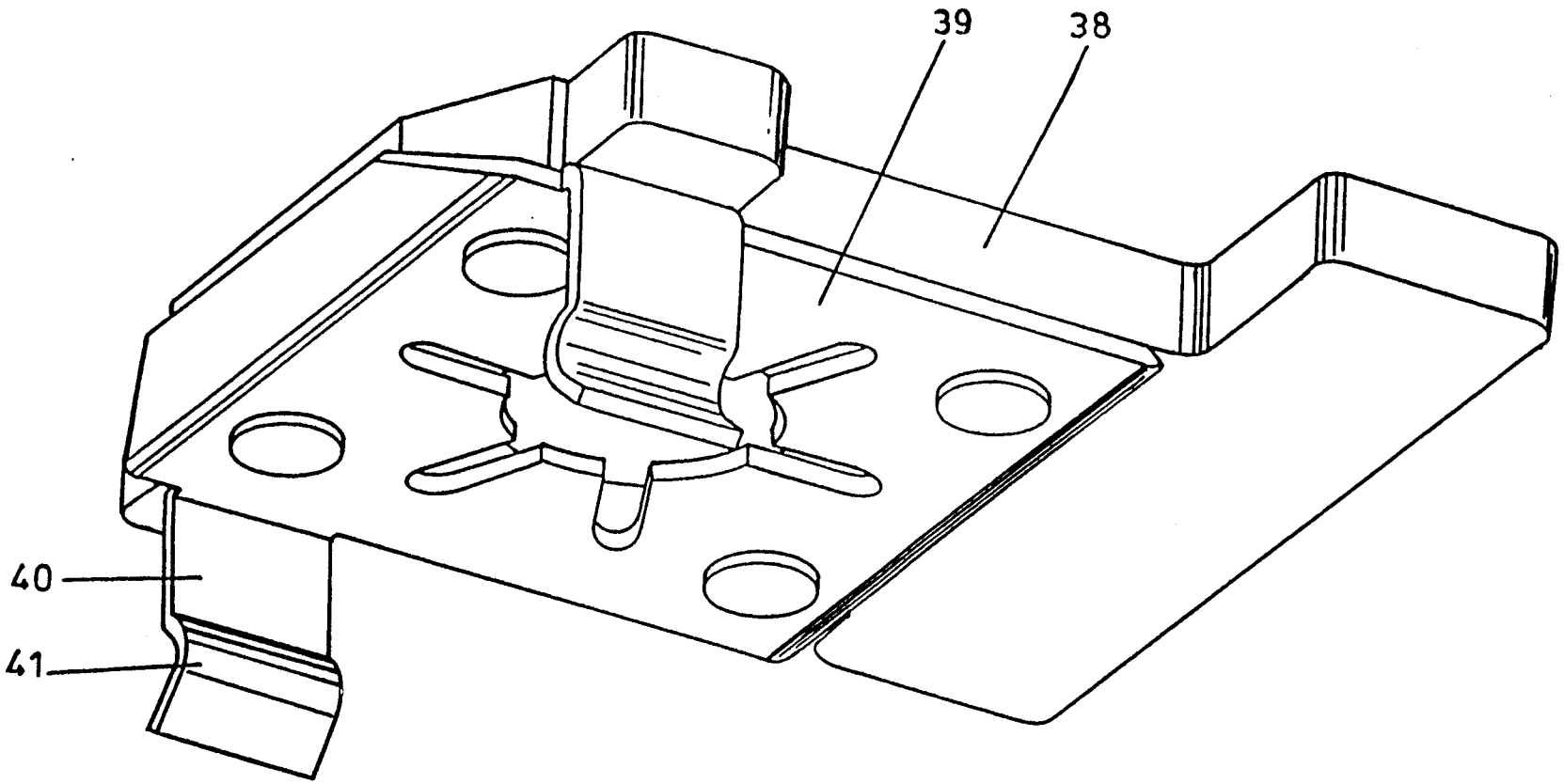

In the case of the embodiment according to FIGS. 6, 7 and 8, the retention of the second clamping plate 43 in the fully open position, abutting against the limit stop of the housing, which limit stop defines the opening movement, is not carried out by friction, but instead by resilient claws 40. These resilient claws 40 are arranged on two opposite sides and comprise, at their ends, an inwardly projecting arch which laps over the edge of the second clamping plate 43. The housing comprises recesses 42 which permit an outward deflection of the ends of the resilient claws 40. In this manner, the second clamping plate 43 is held in its fully open position until, when the clamping screw is screwed in, the arched ends 41 of the resilient claws 40 are pressed back. In this embodiment, the resilient claws 40 are formed integrally with the resilient disc 39. The resilient disc 39 is, again, designed and arranged in the same manner as the resilient disc 33 according to FIGS. 3 to 5.

In FIG. 7, the second clamping plate 43 is illustrated in a plan view, wherein the housing 47, which is composed of nonconductive material or plastics material, is illustrated in a partial section. The resilient claws 40 are arranged at opposite sides of the second clamping plate 43. On the same sides, projections 45 are also arranged on the clamping plate, which projections are guided in grooves 46 in the housing 47 which extend in the axial direction of the clamping screw 8, and ensure the non-rotatability of the second clamping plate 43. In this manner, the cable or the cable terminal may be inserted without difficulty, when the terminal is open, in the direction of the arrow 44 between the first clamping plate 38 and the second clamping plate 43.

I claim:

1. A terminal screw assembly for the electrical connection of cables or wires comprising:

a housing;

a clamping screw in said housing having a head and a shank, the shank including a first threaded portion of a first diameter and a second portion of a second diameter less than said first diameter, said second portion located axially between said first portion and said head;

a first clamping plate in said housing having a first bore for receiving said first portion of said clamping screw in screw-connectable relationship, said first clamping plate being non-rotatable and non-displaceable in an axial direction of said clamping screw a second clamping plate in said housing having a second bore for threadably receiving said first portion of said clamping screw; said second clamping plate being non-rotatable but guidable in said housing in said axial direction of said clamping screw;

wherein said second portion of said shank has an axial length which is at least equal to a thickness of said first clamping plate, and whereupon tightening said clamping screw, said first threaded portion passes through said first bore and threadably engages said second bore, thereby causing said second plate to move toward said first plate so that a cable or cable terminal may be clamped between said first and second clamping plates.

2. The terminal screw assembly according to claim 1 wherein said housing is shaped so as to prevent said clamping screw from being detached from said first clamping plate when said clamping screw is loosened to move said second plate away from said first plate to a maximum open position where said clamping screw is separated from said second clamping plate, and further wherein, in said maximum open position, said second clamping plate is held in said housing.

3. A terminal screw assembly according to claim 2 wherein said first bore of said first clamping late is designed without an internal screw thread, but includes inwardly projecting projections which form parts of threads and which are engageable in said first threaded portion of said clamping screw to provide said screw-connectable relationship.

4. A terminal screw assembly according to claim 3 wherein said projections are formed adjacent a clamping face of said first clamping plate which faces said second clamping plate.

5. A terminal screw assembly according to claim 3 wherein said projections are provided on a resilient disc which is connected to said first clamping plate, said disk provided with a third bore aligned with said first bore, the diameter of said third bore being smaller than said first threaded portion of said shank and larger than said second portion of said shank, and wherein a plurality of radial slits radiate from said third bore to thereby divide an inner region of the disc into tongues which are engageable in at least one thread of said first threaded portion of said clamping screw.

6. A terminal screw assembly according to claim 5 wherein said resilient disc is attached to a surface of said first clamping plate which faces away form said second clamping plate.

7. A terminal screw assembly according to claim 5 wherein said resilient disc is attached to a surface of said first clamping plate which faces toward said second clamping plate.

8. A terminal screw assembly according to claim 7 wherein said first threaded bore in said first clamping plate is provided with a conical depression on a side facing said resilient disc.

9. A terminal screw assembly according to claim 2 wherein when said clamping screw is in said maximum open position, said clamping screw does not substantially project beyond a clamping face of said first clamping plate.

10. A terminal screw assembly according to claim 1 wherein said housing has an opening for passage of a screw driver to engage said clamping screw, the smallest dimension of said opening being smaller than the diameter of said head of said clamping screw.

11. A terminal screw assembly according to claim 1 wherein a maximum open terminal space between said first and second clamping plates is defined by an abutting of said second clamping plate against said housing.

12. A terminal screw assembly according to claim 3 wherein an axial length of said first threaded portion of said clamping screw is greater than an axial spacing between a clamping face of said second clamping plate and said projections of said first clamping plate when said clamping screw is in said maximum open position.

13. A terminal screw according claim 1 wherein a free end of said shank of said screw comprises a threadless centering pin.

14. A terminal screw assembly according to claim 1 wherein said projections are disposed on an inside diameter which is greater than the diameter of said second portion of said clamping screw by at least 30% of the difference between the diameters of said first and second portions of said clamping screw.

15. A terminal screw assembly according to claim 1 wherein said second clamping late has at least one tongue which extends substantially in said axial direction of said clamping screw, and which is guided between guiding faces of said housing which are also disposed in said axial direction said clamping screw.

16. A terminal screw assembly according to claim 15 wherein said guiding faces of said housing have projections which frictionally engage said at least one tongue.

17. A terminal screw assembly according to claim 2 wherein a plurality of resilient claws are connected to said first clamping plate, free ends of said claws being ached towards the axis of said clamping screw to thereby lap over said second clamping plate and hold said second clamping plate in said housing when said clamping screw is in said maximum open position.

18. A terminal screw assembly according to claim 5 wherein a plurality of resilient claws are connected to said first clamping plate, free ends of said claws being arched towards the axis of said clamping screw to thereby lap over said second clamping plate and hold said second clamping plate in said housing when said clamping screw is in said maximum open position, and wherein said resilient disc is attached to a clamping face of said first clamping plate and said resilient claws form an integral part of said resilient disc.

19. A terminal screw assembly according to claim 5 wherein said resilient disc is composed of beryllium bronze.

20. A terminal screw assembly according to claim 5 wherein said first clamping plate has plug-like projections on a clamping face thereof, which projections engage in holes provided in said resilient disc.

* * * * *